United States Patent [19]

Yamaguchi et al.

[11] Patent Number: 5,009,063

[45] Date of Patent: Apr. 23, 1991

[54] ROTARY RING SPINNING DEVICE PROVIDED WITH A RING MOTOR

[75] Inventors: Hiroshi Yamaguchi, 9-7, Ooyamada 4-chome, Kuwana-shi, Mie, Japan; Masashi Yamaguchi, 12-7, Shimizuoka 1-chome, Sumiyoshi-ku, Osaka-shi; Osaka, Japan

[73] Assignees: Hiroshi Yamaguchi, Japan; Niroshi Kimura, Japan; Masashi Yamaguchi, Japan

[21] Appl. No.: 433,342

[22] Filed: Nov. 8, 1989

[30] Foreign Application Priority Data

Nov. 8, 1988 [JP] Japan ..... 63-282854
Apr. 26, 1989 [JP] Japan ..... 1-107060

[51] Int. Cl.[5] ..... D01H 7/58

[52] U.S. Cl. ..... 57/124; 57/75; 57/100

[58] Field of Search ..... 57/75, 100, 101, 122, 57/124

[56] References Cited

U.S. PATENT DOCUMENTS

| | | | |
|---|---|---|---|
| 2,932,152 | 4/1960 | Jackson | 57/124 X |
| 3,543,503 | 12/1968 | Watabe et al. | 57/75 |
| 3,785,140 | 1/1974 | Muller | 57/100 |
| 3,851,448 | 12/1974 | Sano et al. | 57/124 X |
| 4,023,342 | 5/1977 | Schenkel | 57/124 X |

FOREIGN PATENT DOCUMENTS

| | | |
|---|---|---|
| 1812028 | 6/1970 | Fed. Rep. of Germany . |
| 1926799 | 11/1970 | Fed. Rep. of Germany . |
| 1964478 | 7/1971 | Fed. Rep. of Germany . |

OTHER PUBLICATIONS

Patent Abstracts of Japan, vol. 10, No. 219 (C-363) (2275); Jul. 31, 1986.

Patent Abstracts of Japan, vol. 10, No. 355 (C-388) (2411); Nov. 29, 1986.

*Primary Examiner*—Joseph J. Hail, III

*Attorney, Agent, or Firm*—Stevens, Davis, Miller & Mosher

[57] ABSTRACT

A rotary ring spinning device in combination with a spindle, and utilized for a ring spinning machine provided with ring rail lifting mechanism, comprises a holder for rigidly mounting a rotary ring spinning device to the ring rail, a rotary ring body rotatably mounted on the holder via a bearing, and an inner motor disposed in an annular space formed between the rotary ring body and the holder coaxially thereto. The above-mentioned inner motor comprises an annular horizontal rotor made of a permanent magnet secured to an outside peripheral surface of the rotary ring body at an axially central position thereof, and a horizontal annular armature secured to an inside peripheral surface of the holder at a position facing the outside peripheral surface of the rotor, whereby the rotation speed of the inner motor can be controlled by an external electric power input, and the spinning operation can be carried out while controlling the rotation speed of the inner motor to vary the rotation speed thereof in a predetermined relationship to the spindle rotation speed.

10 Claims, 10 Drawing Sheets

ROTARY RING SPINNING DEVICE PROVIDED WITH A RING MOTOR

BACKGROUND OF THE INVENTION

1. Field of the Invention

The present invention relates to a rotary ring spinning device provided with a ring motor, particularly to a rotary ring spinning device provided with a ring motor in combination with a drive control device.

2. Description of the Related Art

Several rotary ring spinning devices have been developed for a ring spinning frame, ring twisting frame, and roving twister etc., as a yarn winding and twisting device, and some are now utilized in practice. Typical of these devices is the spinning device disclosed in Japanese Unexamined Patent application, Showa 63(1988)-223249.

With regard to the drive system of these rotary ring spinning devices, a positive means for driving the rotary ring, such as utilizing compressed air or a friction pulley, or a negative means for driving the rotary ring, such as utilizing a torque obtained from the frictional pressure generated by a traveller when running around a flange of each ring, are known.

A rotary ring spinning device provided with a ring motor, whereby the rotary ring is electrically driven, is also known [Japanese Unexamined Patent Publication Showa 61 (1986)- 152835]. According to the disclosure of this patent publication, because the rotary ring is driven by an outer-rotor system, the rotary ring must be provided with a larger space than other known rotary rings, as the additional space is needed in particular for the windings of electric wiring forming an armature, of a rotor and for an iron core thereof. Therefore, a larger space must be provided when using the above-mentioned rotary ring, compared with the other types of rotary ring mentioned above. Also, the following problem arises in that the spindle pitch must be enlarged when adopting such a rotary ring spinning device having a larger size due to the drive system. This problem is very serious because the number of spindles in a unit floor space must be reduced, and thus the production capacity of a ring spinning machine utilizing this type of rotary ring spinning device having a larger size is lowered, compared to the use of the other type of rotary ring spinning device.

Since the running speed of the spindle of the other known rotary ring spinning devices is usually maintained within a range of 20,000 to 22,000 r.p.m., and in particular case, a test of the running speed at 30,000 r.p.m. was successfully carried out, if in the rotary ring spinning device provided with an outer-rotor system driving more mentioned above, to maintain the production capacity at the same level as obtained with the above-mentioned known rotary ring spinning device, it is necessary to rotate such a rotary ring spinning device at a higher speed such as between 40,000 and 60,000 r.p.m., because such a rotary ring spinning system needs more installation space than the other known rotary ring spinning device, and therefore, the number of spindles to a spinning frame is reduced in comparison with the above-mentioned other known rotary ring spinning devices. Such a high speed driving of the spindles, however, is not practical, because of problems arising from the machine construction, vibration of the spinning frame, power consumption costs, maintenance of yarn quality, and operation control, etc. On the other hand, as a means for eliminating problems due to possible variations of the yarn tension over a wide range, in the conventional spinning practice certain methods for adjusting the spinning conditions, such as lowering the spindle speed by 10–20% to the speed at which the spindle is driven during formation of a medium size package, during formation of a yarn package from the start to 20–30% of the full yarn package, and during formation of a yarn package from 80–90% of the full yarn package, or a method using a cushion start system for starting the spinning operation, are applied because, during the above-mentioned periods of forming a full sized yarn package, there is a tendency toward an occurrence of frequent yarn breaks. Accordingly, the yarn producing capacity during such a period of adjusting the spindle speed is naturally reduced.

It is further known that, in the case of a negative rotary ring spinning device utilizing a thrust bearing or a pneumatic supporting system, the turning torque of the rotary ring, which corresponds to a relationship between the weight of the rotary ring and the friction pressure of the traveller at the rotary ring, is varied in accordance with variations of the yarn tension, variations due to changes of the stretch length, and instant positioning of the ring rail, which is related to the formation of a part of a yarn package and further, a lifting motion of the ring rail, which involves a building motion, variations of the running speed of a traveller during the formation of each chase of a yarn package, and other factors. Nevertheless, even under such conditions, since the weight of the rotary ring is constant, when the upright component of the spinning tension, which pulls the rotary ring upwards along the spindle shaft, exceeds the weight of the rotary ring, the rotary ring rotates at a higher speed. Therefore, if a braking device is not utilized, the speed of rotation of the rotary ring is gradually increased, and accordingly, the working condition of the bearing portion becomes the same as a condition of a pneumatic bearing, and the driving speed of the rotary ring rapidly reaches the rotary speed of the traveller.

Once the rotation speed of the rotary ring is synchronized with the running speed of the traveller, even if the running speed of the traveller is changed during the formation of the yarn package in each chase, the rotation speed of the rotary ring is maintained at an almost constant value due to the inertia of the rotary ring. Therefore, the difference in the traveller running speed when the yarn is wound around a cop at the uppermost position of each chase, and when the yarn is wound around the cop at the lowermost position of an identical chase, reaches remarkable values [running speed of the traveller in the former condition becomes half of the running speed of the traveller in the latter condition]. Accordingly, there is a strong possibility that the rotation speed of the rotary ring can overrun the running speed of the traveller, and thus the spinning yarn tension is remarkably varied between positive values and negative values.

Due to the occurrence of this abnormal condition, the yarn passing over the traveller is severely abraded, and thus the yarn quality is lowered. When spinning a yarn of artificial fibers, problems such as the creation of neps due to abrasion, cutting of fibers forming the yarn (creation of neppy yarn), creation of melted portions of the yarn or yellowing of portions of the yarn due to the friction-heat, and frequent yarn breakages, occur.

To solve the above problems, in the operation of the conventional rotary ring spinning devices, the rotation speed of the rotary ring must be maintained at a value lower than the running speed of the traveller, and therefore, it is necessary to create a friction-resistance between the rotary ring and the traveller. But if the yarn tension, which includes a tension based upon the friction-resistance, becomes greater than the inherent strength of the yarn, the spinning yarn is forcibly broken. Therefore, when utilizing the conventional rotary ring, the rotation speed of which cannot be positively controlled, the rotation speed of the spindle is always restricted to a speed 20% to 30% lower than the upper rotation limit of the spindle of the conventional spinning device. In other words, in the case of utilizing the rotary ring spinning devices, a higher speed operation of the spinning frame than that of the conventional spinning device has not been achieved. On the other hand, as a negative rotary ring spinning device which is provided with a function of preventing a synchronous rotation of the rotary ring with the running speed of the traveller, Japanese Unexamined Patent Publication Showa 58 (1983)-156037 discloses a rotary ring spinning device provided with a friction braking device. In addition to the above-mentioned rotary ring spinning device, the applicant has developed a rotary ring spinning device provided with a magnetic braking device actuated by an eddy electric current [Japanese Patent Application Showa 63 (1988)-137931]. Although these rotary ring spinning devices are useful in practice, the former device has a problem of abrasion of the brake shoe, and in the latter device, an exchange of the rotary ring provided with the magnetic brake having a different magnetic force suitable for carrying out the spinning operation for a yarn concerned is required when the type of spinning yarn is changed.

3. SUMMARY OF THE INVENTION

To solve the above-mentioned problems, the object of the present invention is to provide a rotary ring spinning device having a small-sized ring motor provided in the inner rotor system.

A further object of the present invention is to provide the above-mentioned rotary ring spinning device in combination with a control device provided with a function of maintaining the yarn tension at a predetermined value during the spinning operation, so that a high speed spinning operation can be carried out without yarn breakage.

To provide a practical rotary ring spinning device including the above ring motor, the following control system, which comprises a means for detecting a yarn tension, means for setting a most pertinent yarn tension, means for comparing the detected yarn tension with the most pertinent yarn tension, and outputting a control signal for control of the rotation speed of the ring motor, means for controlling the rotation speed of the ring motor when the above control signal is input thereto, is utilized in a combination of the above rotary ring spinning device.

The above-mentioned control system is carried out in relation to a programmed rotation speed of the spindles controlled by a predetermined spinning program. Therefore, in the rotary ring spinning device provided with a ring motor according to the present invention, the armature and the rotor form the inner rotor type ring motor, which is actuated by an outside electric signal, whereby the rotation speed of the rotary ring body is controlled by an electric signal output from the yarn tension control system, and accordingly, the spinning operation can be carried out while maintaining a predetermined yarn tension.

If it is impossible to maintain the tension of the spinning yarn in the above-mentioned desirable condition, instead of controlling the rotation speed of the spindles, the rotation speed of the rotary ring body is controlled so as to maintain the yarn tension in the above-mentioned desirable condition.

4. BRIEF EXPLANATION OF THE DRAWINGS

5. DESCRIPTION OF THE PREFERRED EMBODIMENTS

Figure 1:
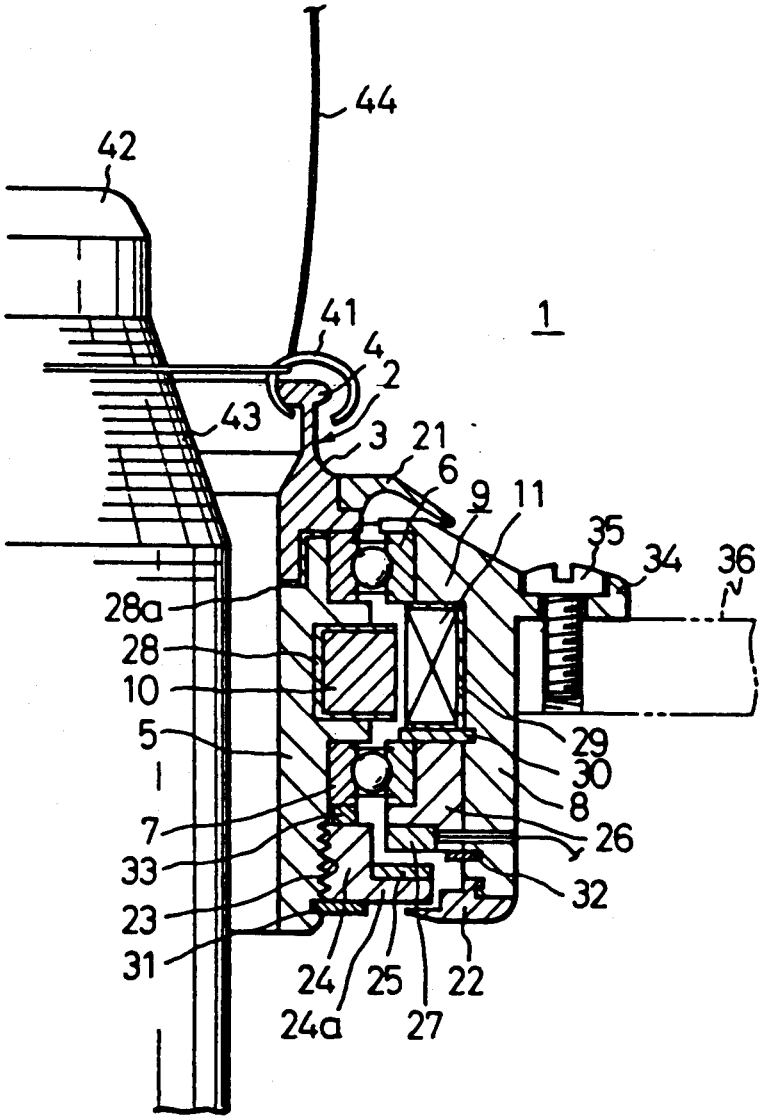
FIG. 1 is partly broken away front cross sectional view of a preferable embodiment of the rotary ring spinning device according to the present invention.

The construction and function of the rotary ring spinning device provided with a ring motor according to the present invention is hereinafter explained in detail.

In a preferred embodiment of the rotary ring spinning device provided with a ring motor, according to the present invention (shown in FIG. 1), a rotary ring 1 comprises a rotary ring body 2 formed as one body by a flange rotor 3 provided with a ring flange 4 and a lower rotor 5, a ring holder 8 rotatably supporting the rotary ring body 2 by a pair of bearings 6, 7, a ring motor 9 which comprises a rotor 10 formed by a permanent magnet disposed in an annular recess formed at an almost central position of the outside cylindrical surface of the rotor ring body 2 along the axial direction thereof, and an armature 11 disposed inside the cylindrical surface of the holder 8 at an almost central position along the axial direction thereof at which the rotor 10 faces the armature 11.

In this embodiment, a known ball bearing is utilized to support the rotary ring body by the holder 8, but a thrust bearing may be used instead of the above-mentioned ball bearing. Other materials such as a material having a high abrasion resistance, a durability against high temperatures, and having a low coefficient of friction, such as an engineering plastic, are also utilized.

A DC motor or a synchronized motor can be used as the ring motor 9, to provide a drive speed corresponding to the electricity supplied (variable electric current or variable voltage or variable frequency).

An upper dust cover 21 is arranged to cover the upper annular opening of the flange rotor 3 and a lower dust cover 22 is arranged to cover the lower annular opening of the holder 8, respectively. A fixing nut 24 is threadingly engaged with a threaded portion 23 formed at the outer peripheral surface of the lower rotor 5 so that the bearing 7 is rigidly mounted in the rotary ring body 1 as shown in FIG. 1. An annular shaped identification plate 25, which is provided with two half annular portions having an identical shape but of a different color, i.e., black and white, is secured on an annular flanged portion 24*a* of the fixing nut 24. Further, a reflection type photocell sensor 27, which detects color changes between the black and white portions of the identification plate 25, is provided to thereby measure the rotation speed of the rotary ring body 2. Instead of utilizing the above-mentioned means for detecting the rotation speed of the rotary ring body 2, a combination of an annular body having a partly cut-off portion and a photo-interrupter, a combination of an annular body having a projected portion and a non-contact limit switch, or a combination of an annular body provided with a portion issuing a magnetic signal, can be utilized for indicating one full rotation of the rotary ring body 2, respectively.

As shown in FIG. 1, spacers 28, 28*a* made of a non-magnetic material, a coil case 29 made of an insulating substance, fixing rings 30, 31 and 32, and a space adjusting ring 33, are utilized as elements constructing the rotary ring spinning device. The holder 8 is provided with a flanged portion 34, and the flanged portion 34 is rigidly mounted by fixing bolts 35 on a ring rail 36. In this drawing, a traveller is indicated by reference numeral 41.

Figure 2:
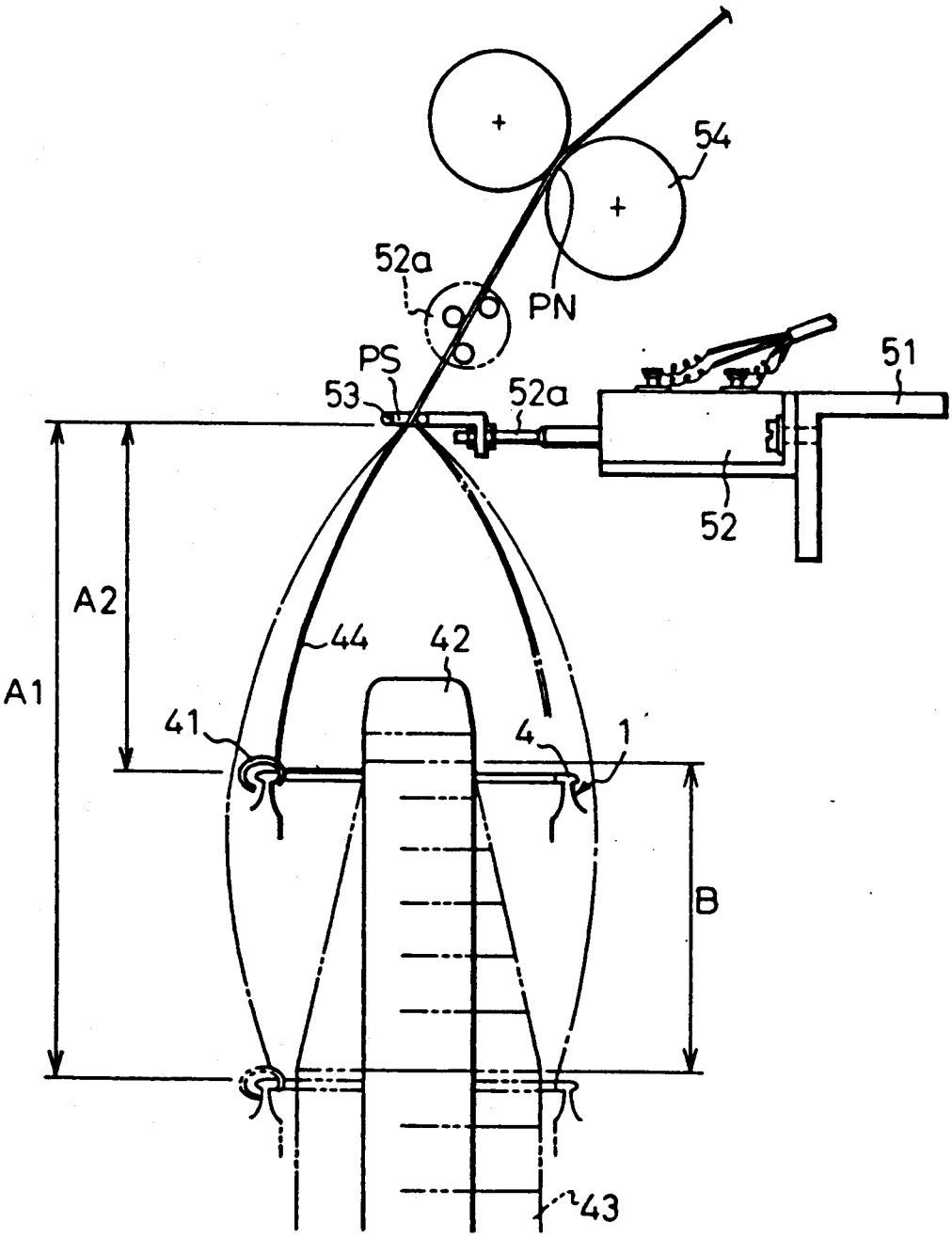
FIG. 2 is an explanatory drawing showing the relationship between the yarn tension and the stretch length during the spinning operation by the rotary ring spinning device shown in FIG. 1.

As shown in FIG. 2, during the spinning operation, the ballooning condition is changed at each step of forming a chase, according to the stretch difference. A sensing device 52 for sensing yarn tension is disposed on a known lappet rail 51.

The sensing device 52 converts the detected load to an electric signal, whereby a delicate change of the load can be detected. Known devices utilizing a semiconductor or strain gauge can be used as the sensing device 52. As shown in FIG. 2, the sensing device 52 detects variations of the balloon tension of a spinning yarn 44 by detecting the horizontal component of the balloon tension of the yarn 44 between the snail wire 53 and the traveller 41 when the yarn 44 passes the ring-shaped snail wire 53 which is rigidly mounted on a detecting rod 53*a* of the sensing device 52, and issues an electric signal according to the above-mentioned detection. The yarn tension between a contact point PS of the yarn 44 to the snail wire 53 and a nip point PN of a front roller 54 is automatically calculated by a central processing unit (hereinafter referred to as the CPU) according to an input signal from the sensing device.

As is well known, in the ring spinning frame having a plurality of spindles, for example, 400 spindles or 1000 spindles, each spinning unit is provided with one snail wire 53. But in the practice of the present invention, the sensing of the spinning yarn tension is applied to a limited number of spinning units, for example, about ten spinning units are utilized for sensing the spinning yarn tension. In this case, the above-mentioned sensing device 52 is mounted on particular spinning units and a plurality of signals output from those sensing devices 52 are computed by the CPU, wherein the average value of the above-mentioned plurality of outputs from all of the sensing devices 52 is utilized to estimate the spinning yarn tension between the above-mentioned points PS and PN, to control the rotation speed of the rotary ring body 1. Instead of applying the above-mentioned system for measuring the spinning yarn tension, a sensing device 52*a* which detects the yarn tension directly can be utilized by mounting this device at an intermediate position between the above-mentioned points PS and PN.

In FIG. 2, a chase is indicated by a letter B, and the balloon stretches at the uppermost position and the lowermost position of the chase B are indicated by A1 and A2, respectively.

A sensing device 61 for detecting the perpendicular position of the lappet rail 51 and the sensing device 62 for detecting the perpendicular position of the ring rail 36 are mounted on the spinning frame to which the present invention is applied. Note the components of these sensing devices, such as a means for detecting the respective positions of the lappet rail 51 and the ring rail 36 along the perpendicular direction, a rack arranged between the lappet rail 51 and the ring rail 36, a pinion gear which engages with the rack, and an encoder which issues an output corresponding to the rotational angular position of the pinion gear, are omitted from FIG. 2.

A condition of indicating the instant size of a yarn package 43 related to the full size yarn package (hereinafter referred to as the instant yarn package forming position) can be detected by the absolute position of the ring rail 36 relative to the bobbin 42 detected by the sensing devices 61, 62, and the stretch lengths A1 and A2 are obtained from the relationship between the perpendicular distances of the ring rail 36 and the lappet rail 51 detected by the above-mentioned sensing devices 61 and 62, respectively. In the operation of the CPU, the perpendicular position of the ring rail 36 at the condition of a full packaged yarn bobbin is represented as 1 and the perpendicular position of the ring rail 36 at the condition of starting the formation of the yarn package is represented as 0, and the rotation speeds of the spindle and rotary ring body are controlled and adjusted to correspond to the instant yarn package forming position.

The lifting distance of the ring rail 36 in each lifting motion, i.e., for the chase B, and the direction of the lifting motion of the ring rail 36 in each lifting motion, can be detected by the system for detecting the position of the ring rail 36. It is well known that, since the stretch, winding speed of the yarn for forming a yarn package and the angle of the winding yarn relative to a bobbin 42 are changed during the spinning operation of forming each chase, there is a tendency for the frequency of yarn breakage to be increased in accordance with changes of the instant position of the ring rail 36 to an upper position during the formation of each chase. To solve this problem, the following control of the rotation speed of the rotary ring body 2 is carried out, i.e., in each chase formation, the rotation speed of the rotary ring body 2 is increased by 5 to 10% at the uppermost position of the chase formation relative to the rotation speed of the rotary ring body 2 at the lower most position of the chase formation, and the time for displacing the ring rail 36 from the above-mentioned lower most position of the chase to the above-mentioned upper most position of the chase is controlled to be twice the time for displacing the ring rail 36 in a direction which is the reverse of the above-mentioned displacement, the control operation of the rotation speed of the rotary ring body 2 for lowering the rotation speed thereof during the downwards displacing of the ring rail 36 is carried out at a time which is one half of the time for elevating the ring rail 36.

Next, the composition and function of the control system preferably applied to the above-mentioned rotary ring spinning device are hereinafter explained in detail.

Figure 3A:
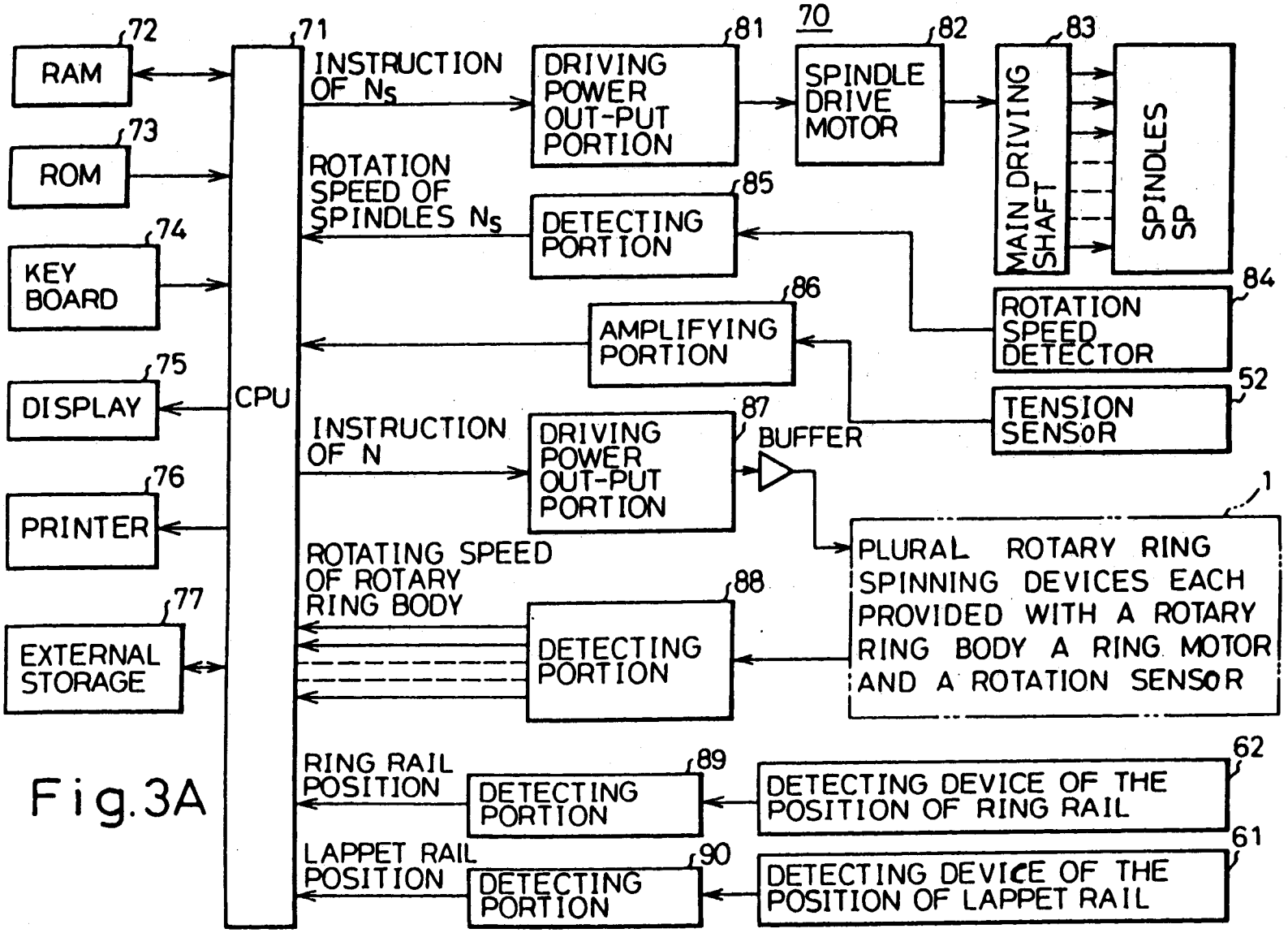
FIG. 3A is a block diagram of the control system utilized for the rotary ring spinning device according to the present invention.
Figure 3B:
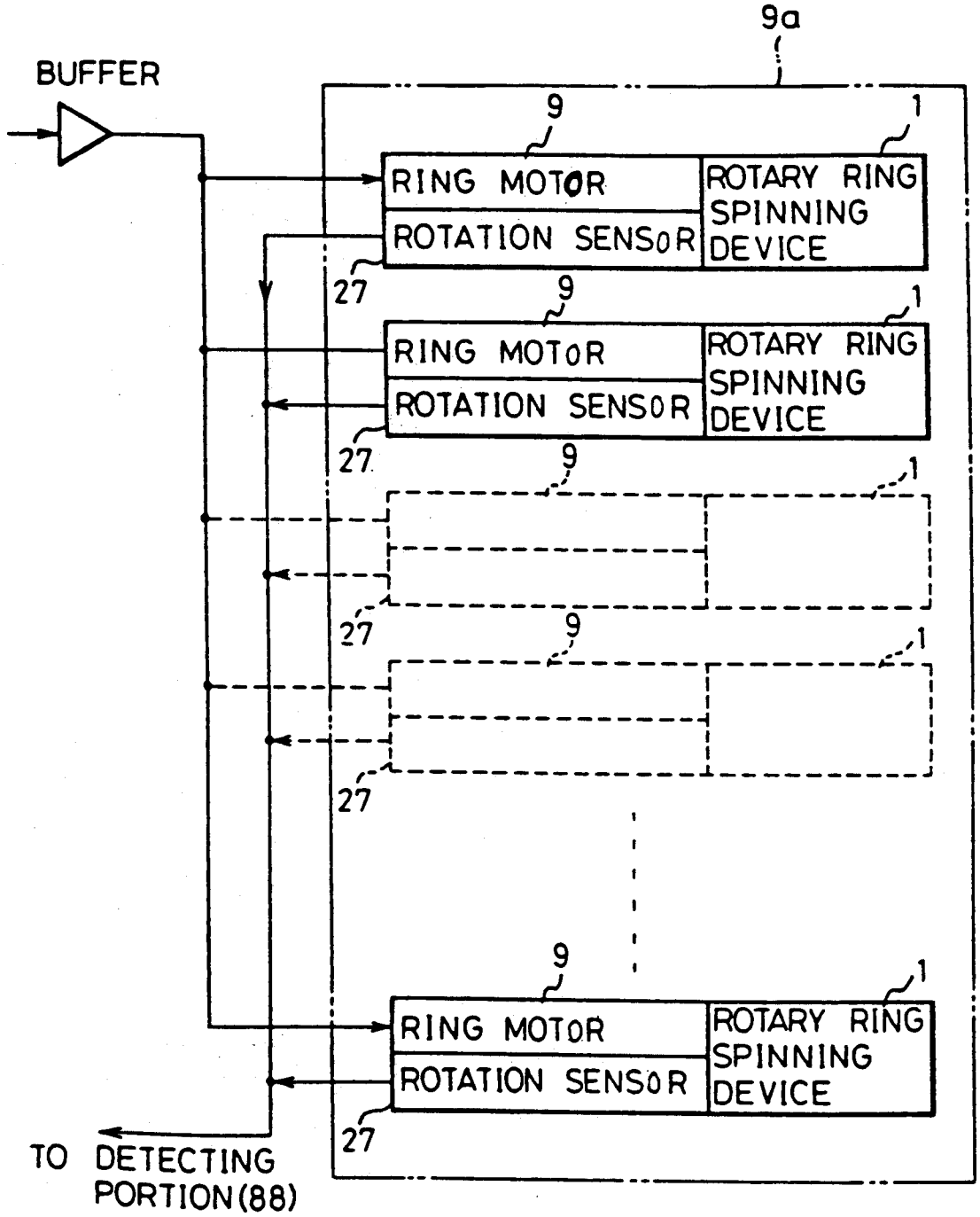
FIG. 3B is a detailed drawing of a part of the block diagram shown in FIG. 3A, showing in greater detail the relation between the buffer and the detecting portion via the rotary ring spinning devices, each provided with a rotation sensor.

Referring to FIGS. 3A, 3B, which is a block diagram of the control system applied to the rotary ring spinning device mentioned above, the CPU 71 comprises a microcomputer and preferable interface circuits etc., connected thereto so that input signals are computed and predetermined data processings are carried out, and signals necessary to actuate the component elements of the control devices are issued.

In FIGS. 3A, 3B, a RAM 72 temporarily stores data and programs, a ROM 73 and the external memory means 77, such as a floppy disc or a hard disc, store the spinning programs of the entire spinning process for producing a yarn, which are designed for all kinds of spun yarn, in relation to yarn counts and types of yarn. The spinning program includes predetermined standard data regarding the rotation speed of the spindles SP and the rotary ring spinning device 1 a spinning frame, which is brought to a condition for maintaining the tension of a spinning yarn within an allowable range for the spinning yarn, and to control the driving speeds of the spindles and the rotary ring bodies of the spinning frame, relative to the respective instant yarn package forming position. Programs for operating the processes which should be controlled by CPU 71, and other programs and data, are stored in the ROM 73 or the external memory means 77.

A key board 74 sets the most desirable yarn tension TS of the yarn 44, and has a function such that data or order-signals are input to the CPU 71.

A display panel 75 is provided with a means for displaying the result of the computation by CPU 71 and the control condition of elements of the spinning frame, such as a Braun tube.

A printer 76 prints several kinds of data and messages.

As is known, the spindles SP of the spinning frame are driven in a predetermined ratio against a main driving shaft 83 of the spinning frame, so as to drive the spindles at faster or slower driving speeds thereof, by a driving motor 82 and the main driving shaft 83. The driving motor 82 is provided with a driving means 81 including an inverter, etc., so that the motor 82 is driven while controlling the driving speed thereof. A device 84 for sensing the rotation speed of the main driving shaft 83 is mounted on the main driving shaft 83, and the output of the device 84 is input to the CPU 71, via a detecting portion 85.

The signal output from the sensing device 52 is input to the CPU via an amplifier 86.

The ring motor 9, which rotates the rotary ring 1, is driven by a driving means 87 under a control condition corresponding to an instruction signal for the rotation speed thereof issued by the CPU 71, and the detected signal of the photocell sensor 27 disposed in each rotary ring body 1 is input to the CPU, via a detecting body 88.

The lappet rail position detecting device 61 and the ring rail position detecting device 62 provided with a detecting means such as a linear scale are mounted on the lappet rail 51 and the ring rail 36, respectively, and the signals issued from these detecting devices 61 and 62 are input to the CPU 71 via detecting bodies 90 and 89, respectively.

Figure 7:
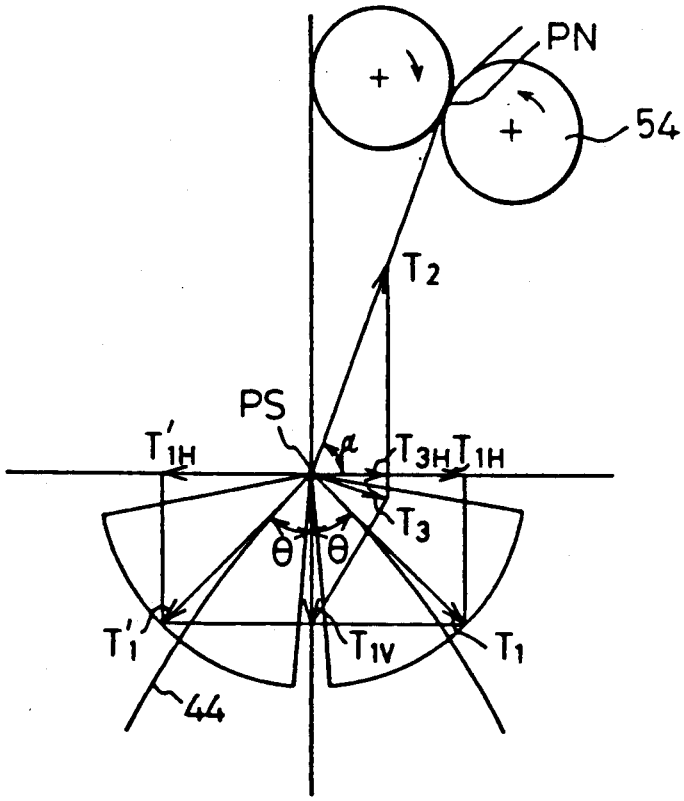
FIG. 7 is an explanatory drawing showing the relationship between the forces applied to the yarn at a position around the snail wire shown in FIG. 2.

Next, a method of determining the tension of the spinning yarn 44 from signals issued from the sensing device 52 is hereinafter explained with reference to FIG. 7.

An imaginary plane P having a straight line passing through the nip point PN and the point PS, which is perpendicular to the axial center lines of the front rollers 54, is considered.

When the balloon of the spinning yarn 44 is located on the above-mentioned plane P, the following equation can stand, $$T3\ H = T2 \times \text{Cos. } \alpha \qquad (1)$$

wherein:

$\alpha$: . . . indicates a spinning angle (angle between a straight line passing through the points PN and PS to a horizontal plane.)

T1: . . . indicates a balloon tension.

T1 V: . . . indicates an average value of perpendicular components of the balloon tension T1 during one full rotation of the traveller along the flange of the rotary ring body.

T2: . . . indicates the upper spinning yarn tension.

T3 H: . . . indicates a horizontal component of T3.

T3: . . . indicates a horizontal component of T3.

It is understood that the balloon tension T1 varies during one full rotation around the flange of the rotary ring body, but the variation of the balloon tension mentioned above is very small, and other factors in the changing of the yarn tension during the above-mentioned one full rotation of the traveller are also negligibly small, therefore the tension of the spinning yarn T2 and Tl V can be considered an average value during the above-mentioned one full rotation of the traveller. Accordingly, T1 V can be estimated as mentioned above.

Under the above-mentioned assumption, the following equation can be introduced, $$T2 = T3\ H \times Sec.\ \alpha \qquad (2)$$

Therefore, the upper spinning yarn tension T2 can be calculated by the equation (2) based upon the above mentioned component T3 H, which can be obtained as a signal issued from the sensing device 52.

Figure 6:
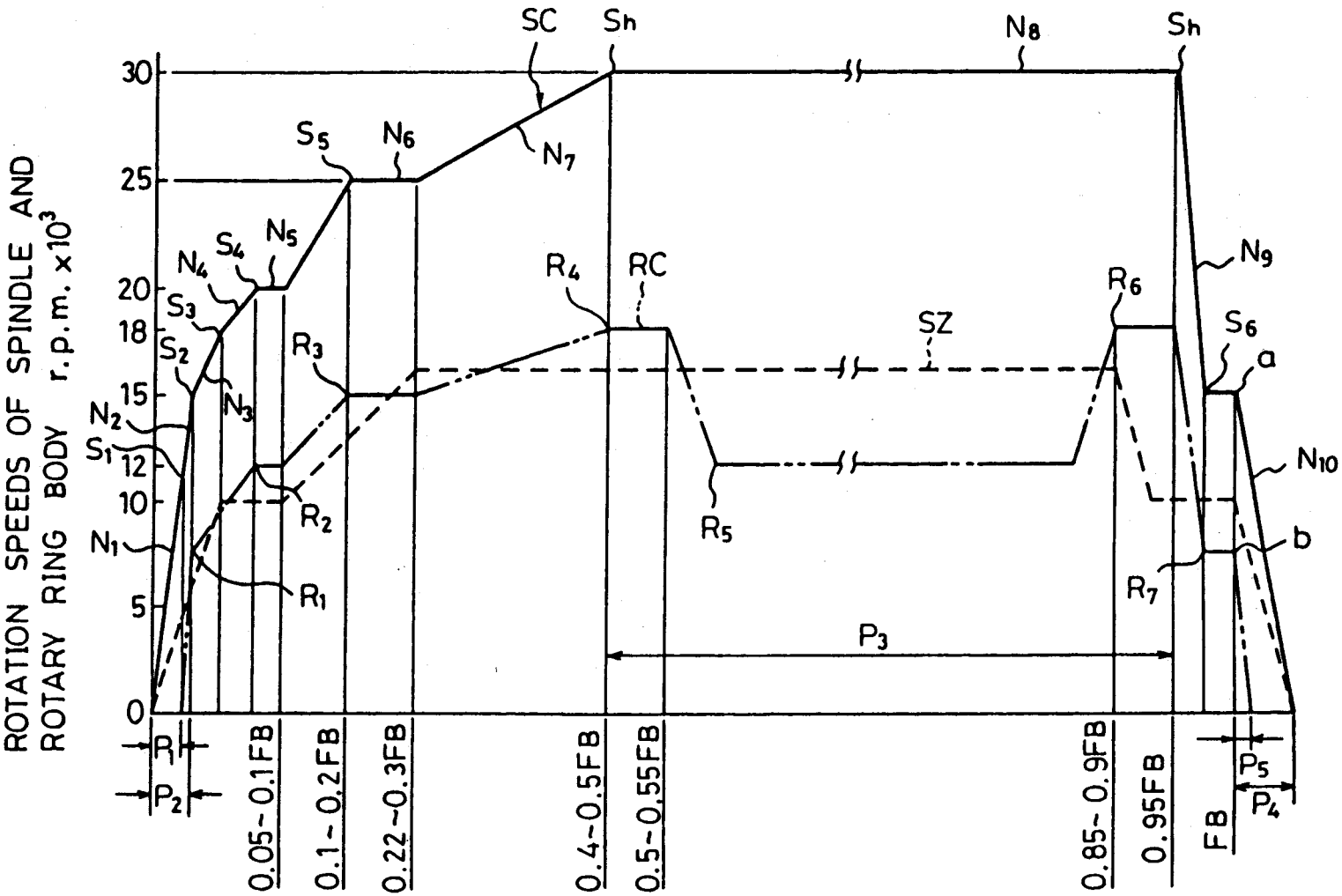
FIG. 6 shows an example of the control of the rotation speed of the rotor ring body related to the spinning program held in the ROM or outside memory.

Next, one example of the system for controlling the rotation speed of the rotary ring body relative to the rotation speed of the spindle based upon the spinning program stored in ROM 73 or the external storage 77, is given with reference to FIG. 6.

In FIG. 6, the abscissa represents the time for forming a full size yarn package by indicating the instant size of the yarn package formed on a bobbin 42 (cop size represented as a percentage relative to the full packaged yarn bobbin) from the time of starting the winding of the yarn on the bobbin 42 to the time at which the formation of a full sized yarn package is completed and the ordinate represents a rotation speed of the spindle SP and the rotary ring body 1, wherein the rotation speed of the spindle SP is indicated in revolutions per minute and the rotation speed of the rotary ring body is indicated by a ratio of the rotation speed thereof relative to the rotation speed of the spindle SP. In FIG. 6, the ratio of the size of the instant yarn package is indicated as follows, i.e., if the size of a instant yarn package is 10% of the size of a full yarn package, this size is represented as 0.1 FB, and if the size of a instant yarn package is 30% of the size of a full yarn package, this size is represented as 0.3 FB, and so on. Note, the size of a full yarn package is represented as FB.

The spinning program related to the rotation speed of the spindles SP differs in accordance with various conditions, such as types of yarn (yarn count, number of twists, etc.), and other conditions related to the spinning frame. In the spinning of, for example, a middle count-class cotton yarn (40 s to 60 s cotton counts) shown in FIG. 6, during the period from starting the spinning operation to produce a full yarn package from 0.3 FB, the rotation speed NS of the spindles is stepwisely increased such that the yarn tension is restricted to prevent yarn breakage, and then increased to the upper limit such as 25,000 to 30,000 r.p.m., in accordance with the type of yarn produced and the machine condition of the spinning frame.

A typical control program for controlling the spinning operation of the rotary ring spinning device according to the present invention under a predetermined spinning program shown in FIG. 6 is hereinafter explained in detail.

(1) First the following program is set-up by a program line SC. Namely, the rotation speed (Ns) of the spindles SP at the starting period P1 is usually set to reach a speed (S1) within range of 10,000 and 12,000 r.p.m., (represented as S1 in FIG. 6). The portion of the program line SC corresponding to the period PI is represented by N1 in FIG. 6. The starting period (P1), which represents a starting portion of the program line SC, differs in accordance with the type of spinning yarn, but the period Pl is usually set to a range of between 5 and 10 seconds.

The time point for starting the program line (RC) in this period P1 is designed as follows, that is, in this period P1, the rotation speed of the rotary ring body 2 is set to zero and this program is set in such a way that the rotary ring body 1 is started in its rotation; after a time delay of between 5 and 10 seconds after the rotation speed of the spindles SP reaches the above-mentioned speed S1 within a range of between 10,000 and 12,000 r.p.m. The portion of the program line SC corresponding to the period P1 is represented by N1 in FIG. 6.

(2) After the rotation speed of the spindles SP reaches the above-mentioned speed S1, the speed is set to reach a speed of about 15,000 r.p.m., which is about half the desired maximum speed (S.h), within a period P2 of between 20 to 30 secs., after the time of switch-on. This speed is represented as S2 in the program line SC. Thereafter, the rotation speed of the spindle SP is further increased to a speed S3, which is about 60% of the maximum speed (S.h), within 60 sec. after the time of switch-on, and the rotation speed is further increased to a speed S4, which is about ⅔ of the maximum speed (Sh), i.e., 20,000 r.p.m. The portions of the program line SC related to these spindles speeds are represented by N2, N3, and N4, respectively, in FIG. 6, and the above-mentioned operations for increasing the rotation speed of the spindles SP are carried out as a first step of the spinning program.

Thereafter, the rotation speeds of the spindles SP are maintained at the speed S4 until the formation of an initial bottom tail portion of a yarn package, which corresponds to a size in a range of between 0.05 and 0.1. of the full size yarn package (represented as FB), is completed. The portion of the program line SC is represented as N5, and the above-mentioned control of the rotation speed S of the spindles SP is carried out as a second step of the spinning program.

During the above-mentioned operation of increasing the rotation speed of the spindles SP, the rotation speed of the rotary ring body 2 is increased in accordance with the following program line under control. Namely, the rotation speed of the rotary ring body 2, the rotation speed of is also increased under control, according to such program which starts at the time corresponding to the point S1 of the program line SC and the speed thereof reaches a speed R1 at a time point corresponding to the point S2 on the program line SC. The speed R1 is programmed to be within a range of between 40% and 50% of the rotation speed of the spindles SP. The rotation speed of the rotary ring body 2 is further increased and reaches a speed R2 at a time point corresponding to the point S4 on the program line SC. The rotation speed R2 is programmed as a value within a range of between 50% and 60% of the rotation speed of the spindles SP. In other words, even if the starting of the rotation of the rotary ring body 2 is delayed as mentioned above, the rotation speed of the rotary ring body 2 is increased in accordance with the elevation of the rotation speed of the spindles SP, as mentioned above, by the above-mentioned program, and at the end point of step 1 of the spinning program for the spindles SP, the rotation speed of the rotary ring body 2 reaches 10,000 to 12,000 r.p.m.

(3) Thereafter, the rotation speed of the spindles SP is increased to a speed S5, which is 85% of the maximum rotation speed Sh of the spindle SP, i.e., 25,000 r.p.m., until the size of the instant yarn package becomes 0.1 to 0.2 FB, and the rotation speed of the spindles SP is maintained at the same level S5 until the instant size of the yarn package becomes 0.22 FB to 0.3 FB, whereby the formation of the bottom portion of the yarn package is completed. The portion of the program line SC of the spindles SP at the above-mentioned constant speed is represented as N6. Thereafter, the rotation speed of the spindles SP is continuously increased according to the control program represented by a gently sloped program line N7. This portion of the above-mentioned control program SC is designed so that when the size of the yarn package becomes a size in a range of between 0.45 FB and 0.5 FB, the rotation speed of spindles is at its maximum Sh.

During the above-mentioned increase of the rotation speed of the spindles SP, the rotation speed of the rotary ring body 2 is increased to a speed Namely, after the rotation speed of the rotary ring body 2 reaches the speed R2, the rotation speed of the rotary ring body 2 is maintained at the speed R2 for a period identical to that of the portion N5 of the program line SC, and then increased to a speed R3 when the rotation speed of the spindles SP reaches the speed 35. This speed R3 is within a range of between 50% and 60% of the rotation speed of the spindles SP. During the period that the instant size of the yarn package becomes within a range of between 0.22 FB and 0.8 FB, the rotation speed of the rotary ring body 2 is maintained at R3, and the above-mentioned condition is terminated at a time identical to the termination of the portion N6 of the program line SC. with an increase of the rotation speed SP, whereby possible yarn breakage is prevented by maintaining a stable relative speed between the rotation speed of the rotary ring body 2 and the traveller 41. During the above-mentioned period of increasing the rotation speed of the rotary ring body 2, the rotation speed of the rotary ring body 2 is controlled by the program, so that the creation of shock due to variations of the spinning yarn tension, created by variations of stretch and changes of the winding angle to the bobbin, can be absorbed, and therefore, the spinning yarn tension can be maintained in the required condition.

(4) Thereafter, the rotation speed of the spindles SP is maintained at the maximum speed Sh until the instant size of the yarn package becomes 0.95 FB. The above-mentioned period in which the spindles SP are rotated at the maximum rotation speed Sh is represented as P3 and the portion of the program line SC in the period P3 is represented as N8 in FIG. 6, and during this period, a stable spinning yarn tension is maintained, and thus the possible yarn breakage is prevented.

Then the rotation speed of the rotary ring body 2 is continuously increased to the rotation speed R4 at the same time as the rotation speed of the spindles SP reaches the speed Sh, as shown in FIG. 6, and thereafter the rotation speed of the rotary ring body 2 is continuously maintained at the rotation speed R4 until the instant size of the yarn package becomes within a range of between 0.5 and 0.55 FB, subsequently, the rotation speed of the rotary ring body 2 is decreased to a speed K4 within a range of between 40% and 50% of the maximum rotation speed Sh of the spindles SP, as shown in FIG. 6, and this condition is maintained until a time close to a condition in which the instant size of the yarn package becomes 0.85 FB and 0.9 FB, and thereafter, the rotation speed of the rotary ring body 2 is increased to the rotation speed R6 until the size of the yarn package becomes a size within a range of between 0.85 FB and 0.9 FB, and then the rotation speed of the rotary ring body 2 is maintained R6 until the size of the yarn package becomes 0.95 FB.

Figure 5:
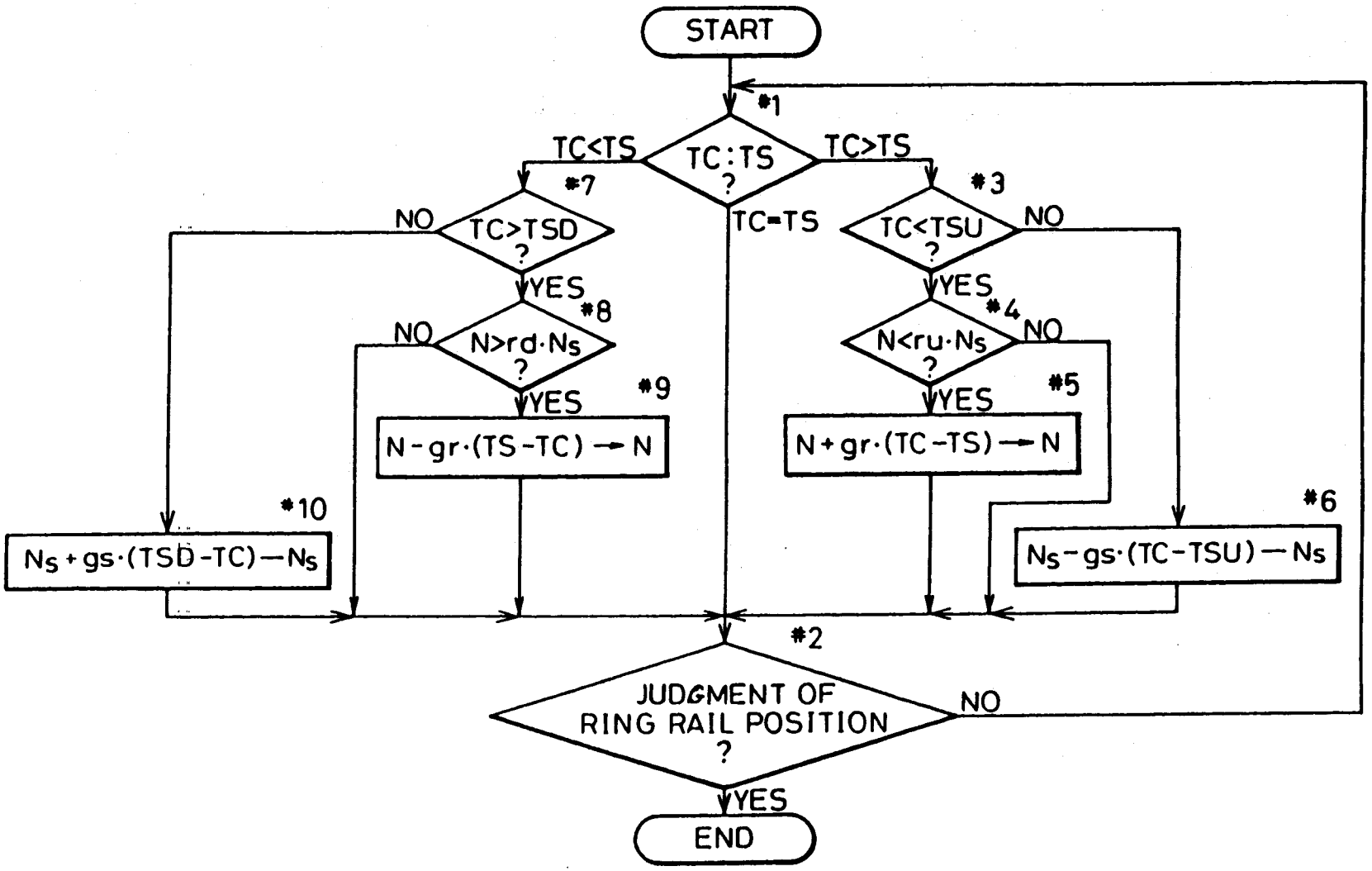
FIG. 5 is a flow chart of the rotation speed control operation of the yarn tension control system according to the present invention.

As explained in detail with reference to FIG. 5, the rotation speed of the rotary ring body 2 is controlled within a range of between 40% and 50% of the rotation speed of the spindles SP under the reduced condition of the rotation speed thereof, so as to carry out so-called running control of the rotary ring body 2, so that the reaction of shock due to variations of spinning yarn tension, created by variation of stretch and change of the winding angle to the bobbin, can be absorbed, and therefore, the spinning yarn tension can be maintained in the required condition for preventing occurrence of yarn breakages.

During the stable spinning condition of forming the medium size portion of the yarn package, the rotation speed of the rotary ring body 2 is controlled as mentioned above, and accordingly, the power consumption during this longest period of driving the spindles SP at a highest rotation speed can be remarkably reduced. Moreover, the durability of the bearing portion of the rotary ring spinning devices, which might be damaged by abrasion, can be extended.

(5) Just before or just after the instant size of the yarn package becomes a size of 0.95 FB, the rotation speed S6 of the spindles SP is reduced to a speed within a range of between ½ and ⅔ of the maximum rotation speed Sh of the spindles SP, by the program line N9, and the speed is maintained until the instant size of the yarn package reaches the full packaged condition FB, which time point is represented by (a) in the program line SC, the switch of the driving motor of the spinning frame is made OFF by a signal indicating the completion of forming the full packaged yarn packages, so that the ring rail 36 is automatically displaced downwards to the standby position, the winding of tail ends around each full size yarn package is completed, and the spindles SP are completely stopped. During the above-mentioned final stage of changing the rotation speed of the spindles SP, the rotation speed of the rotary ring body 2 is also changed under controlled condition as follows: the rotation speed of the rotary ring body 2 is reduced from its rotation speed R6 at the time point when the rotation speed of the spindles SP is reduced from the maximum speed Sh thereof, and changed to the rotation speed thereof R7 at the time point when the rotation speed of the spindles SP becomes S6 as shown in FIG. 6. The rotation speed R7 of the rotary ring body 2 is 6,000 r.p.m. which corresponds to a ratio in a range of between 30% and 40% of the rotation speed of the spindles SP at the identical time point. The rotation speed of the rotary ring body 2 in maintained at R7 until the time point (b) which corresponds to the time point (A) of the program line SC regarding the rotation speed of the spindles SP, so that the inertia of the rotary ring body 2 is remarkably reduced.

The time needed to completely stop the rotation of the spindles SP after switching off the main driving motor of the ring spinning frame, when the size of the yarn package becomes full size, varies in accordance with the type of the ring spinning frame, the means for braking the rotation of the spindles etc., however, it is necessary to completely stop the rotation of the rotary ring body 2 not later than the time when the rotation of the corresponding spindles is completely stopped, for example, as shown in FIG. 6, it is preferable to stop the rotation of the rotary ring body 2 before the time of stopping the rotation of the spindles SP. The rotation speed of the rotary ring body 2 is controlled to satisfy the condition that the time P4, which is necessary for completely stopping the rotation of the spindles SP after switching off the motor of the ring spinning frame, is longer than the time p5 which is necessary to completely stop the rotation of the rotary ring body 2 after the time point (b).

In FIG. 6, the program line represented by SZ indicates the program for carrying out the formation of a yarn package by a conventional ring spinning frame, wherein the rotating speed of the spindles is changed only under the above-mentioned control program. As is obvious from these control program lines SC and SZ, the maximum rotation speed of the spindles SP is remarkably different, and thus it is clear that the production capacity of the rotary spinning device according to the present invention is superior to that of the conventional spinning devices.

Figure 4A:
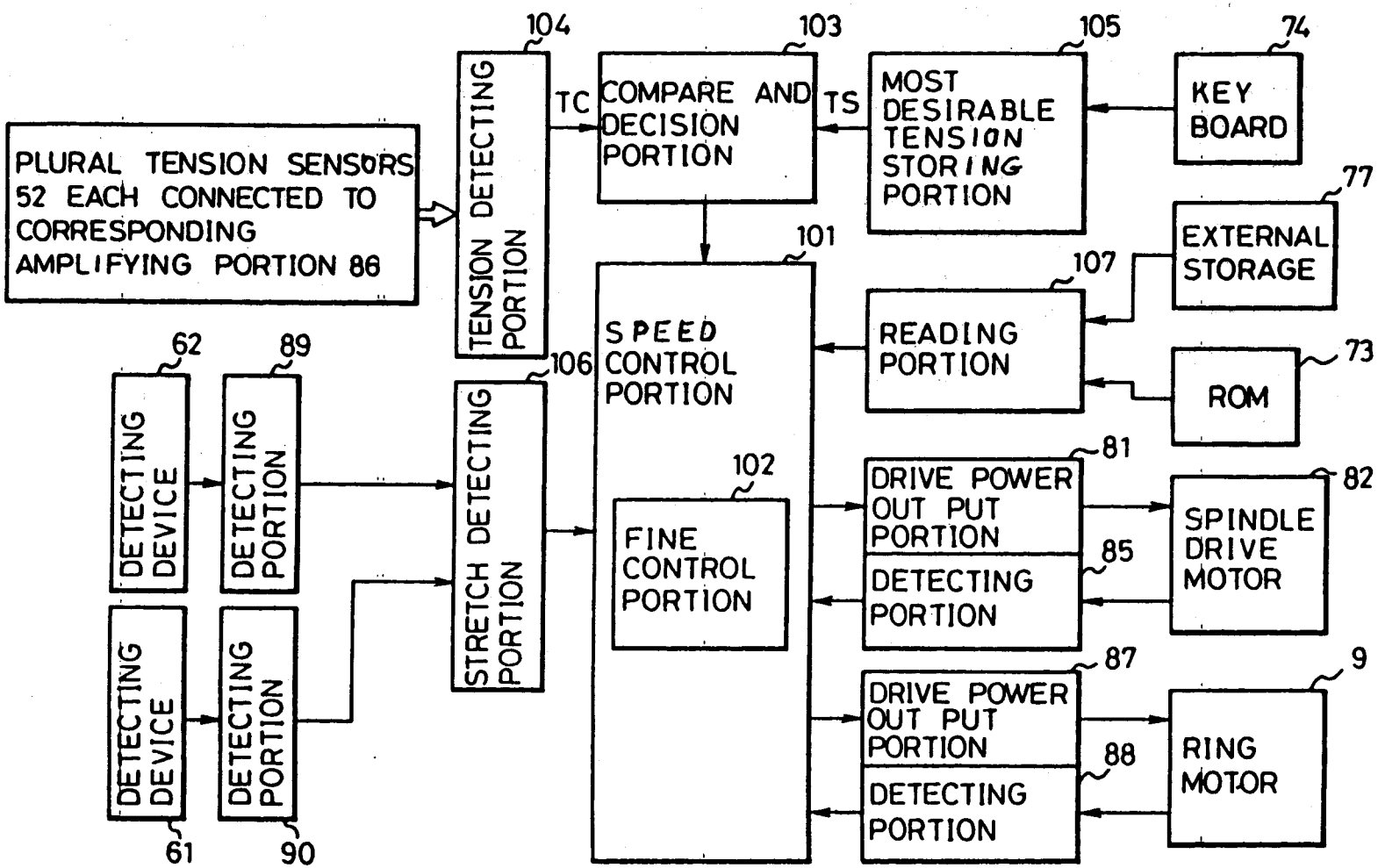
FIG. 4A is a block diagram indicating the function of a CPU having a ROM or a program held in an outside memory, applied for the yarn tension control system according to the present invention.
Figure 4B:
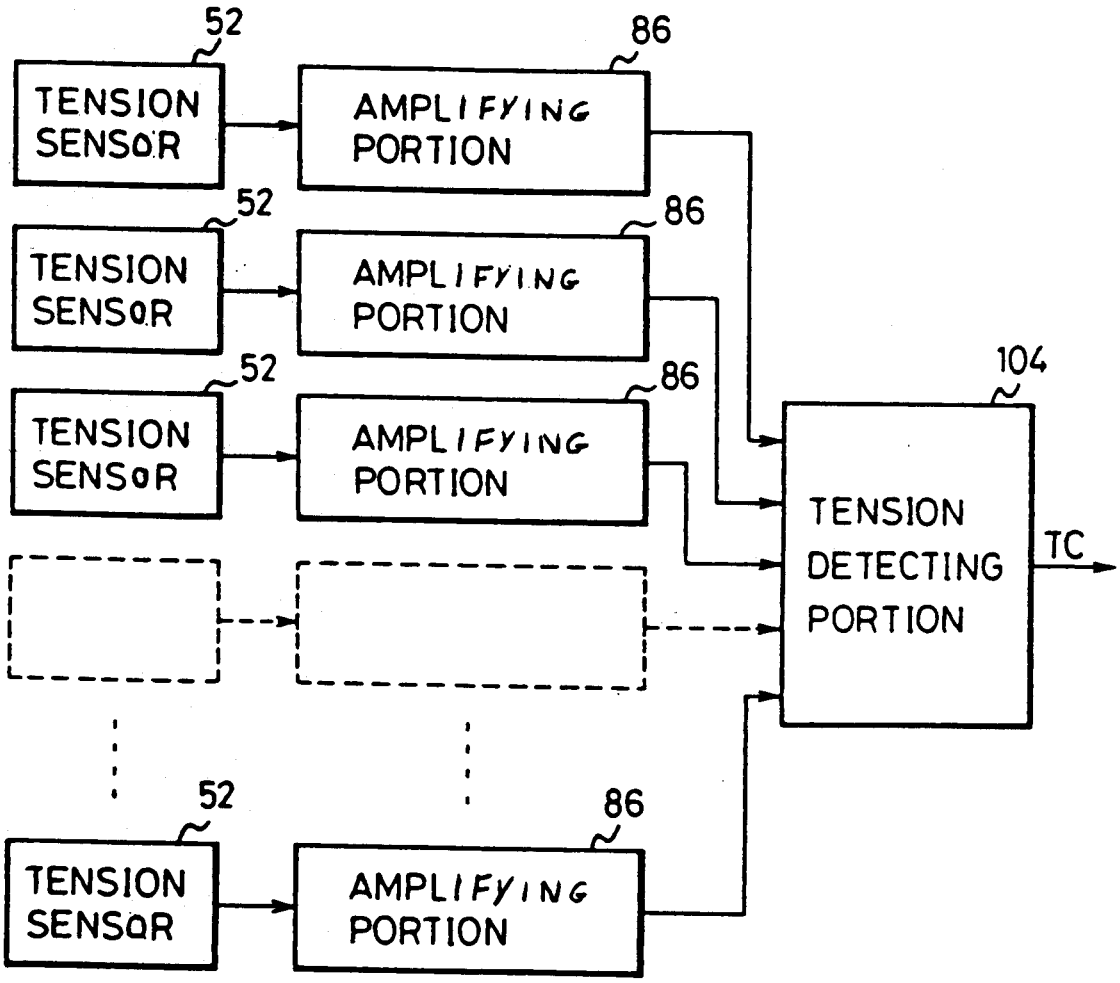
FIG. 4B is a detailed drawing of a part of the block diagram shown in FIG. 4A, showing in greater detail the relation between the plural tension sensors and the tension detecting portion.

The operation of the above-mentioned control device 70 is hereinafter explained in detail with reference to FIGS. 4A and 4B.

When the yarn package forming operation is started, to produce a specified yarn, the spinning program for the specified yarn is read from the ROM 73 or the external memory 37 by way of a portion 107 for reading the program, and a speed control portion 101 outputs a signal to the drive mechanisms 81 and 87, to control the driving speeds of the spindles SP and the rotating rotary ring body 2.

The detecting portion 85 detects the rotation speed of the spindles by measuring the rotation speed of a main driving shaft 83 of the spinning frame concerned, by a rotation speed detector 84, and the detecting portion 88 detects the rotation speed of the rotary ring body by a detecting means already mentioned in the explanation of the rotary ring spinning device shown in FIG. 1.

It is not necessary to arrange the means for detecting the spinning yarn tension at all of the rotary ring spinning devices 1, in spite of utilizing the ring motor 9 for all of the rotary ring spinning devices 1, because in the present invention an average yarn tension is obtained from signals taken from a plurality of signals issued from the above-mentioned plurality detecting means.

The portion 101 for controlling the rotation speed of the spindles SP issues signals to the drive portions 81 and 87 for controlling the rotation speeds of the spindles SP.

The stretch detecting member 106 detects the stretch length, based upon the detection signals output from the detecting member 61 for detecting the position of the lappet rail 51 and from the detecting member 62 for detecting the position of the ring rail 36.

The tension sensing device 104 operates as follows; first a plurality of signals output by the tension sensors 52 are classified in such manner that, if a signal indicates a value lower than a predetermined value, this signal is judged to indicate a yarn breakage, and such a detected signal is omitted from the signals for calculating the average value of the detected signals, to indicate the average yarn tension TC.

A memory 105 stores the most desirable yarn tensions designed for the respective types of yarn product, by operating the key board 74, and one of the most desirable yarn tensions stored in the memory 105 is selected and read from the memory 105 to carry out the spinning operation of a particular yarn.

The comparison and judging portion 103 compares the average tension TC with the selected most desirable yarn tension TS, and a difference TK obtained from the above-mentioned comparison is output, and further, the result of the judgement of whether the average yarn tension TC is in an allowable tension range EK is output where EK is defined by an allowable upper line tension TRU and the allowable lower limit tension TSU, or if the average yarn tension TC is outside the allowable tension range EK, on which side of the allowable tension range is the average yarn tension TC positioned is output.

The speed control portion 101 carries out the controlled adjustment of the driving speed of the spindles SP and the rotary ring body 2 by the fine control portion 102, based on the result output by the above-mentioned comparison and judging portion 103.

The steps of the above-mentioned comparison and judgement in relation to the spinning operation are explained with reference to FIG. 5, and FIG. 6.

Regarding the rotation speed Ns of the spindles SP and the rotation speed N of the rotary ring body 2, which are set by the spinning program shown in FIG. 6, the average tension TC of the spinning yarns is compared with the most desirable yarn tension Ts (step #1). If the average tension TC is equal to the most desirable yarn tension Ts, the spinning operation is continuously carried out without changing the rotation speed N of the rotary ring body 2 and the rotation speed NS of the spindles SP, and step 2 is carried out as explained later.

In step #1, if the average yarn tension TC is greater than the most desirable yarn tension Ts, it is determined whether or not the average yarn tension TC exceeds the upper allowable limit TSU of the most desirable yarn tension TC (step #3).

If the result in the step #3 is yes, i.e., the average yarn tension TC does not exceed the allowable limit TSU and is within the predetermined allowable range EK, it is determined whether or not the rotation speed N of the rotary ring body 2 is lower than the product of the rotation speed Ns of the spindle and the upper allowable ratio ru, i.e., [(Ns)×(ru)] (step #4).

If the result in the step #4 is yes, to increase the rotation speed N of the rotary ring body 2, the sum i.e., the product of the difference between the average yarn tension TC and the most desirable yarn tension Ts and the gain (gr) and the instant rotation speed N of the rotary ring body 2 is set as a new set value of the rotation speed N of the rotary ring body 2 (step #5).

If the result in step #4 is no, i.e., the set value of the rotation speed N of the rotary ring body 2 exceeds the set value of the upper limit, i.e., of the rotation speeds N of the rotary ring body 2, without changing the rotation speed of N of the rotary ring body 2 and the rotation speed of NS of the spindles SP, because the rotation speed N of the rotary ring body 2 is not able to further increase.

If the result in the step #3 is no, to decrease the rotation speed of the spindles SP, the subtracted value, i.e., the product of the difference between the average yarn tension Tc and the upper tension limit TSU and the gain gs from the preset rotation speed NS of the spindles SP is set as a new set value of the rotation speed Ns of the spindles SP (step #6).

In Step #1, if the average yarn tension TC is smaller than the most desirable yarn tension TC, it is determined whether or not the average yarn tension TC exceeds the lower allowable yarn tension TSD (step #7).

In step #7, if the result is yes, i.e., the average yarn tension TC is not lower than the lower allowable yarn tension TSD and is within the allowable range of the yarn tension EK, it is determined whether or not the rotation speed N of the rotary ring body 2 exceeds the product of the rotation speed Ns of the spindles SP and the ratio of lower limit rd (step #8).

If the result in the step #8 is yes, to decrease the rotation speed of the rotary ring body 2, the difference between the product of the difference between the most desirable yarn tension TS and the average yarn tension TC and the gain gr and the present rotation speed of the rotary ring body 2 is set as a new rotating speed N of the rotary ring body 2 to decrease the rotation speed of the rotary ring body 2 (step #9).

If the result in the step #8 is no, i.e., the rotation speed N of the rotary ring body 2 is lower than the set value of the lower limit, i.e., the product of the rotation speed NS of the spindles SP and the ratio of the lower limit rd, it is unable to further reduce the rotation speed of the rotary ring body 2, and accordingly, step #2 is started without changing the rotation speed N of the rotary ring body 2 and the rotation speed Ns of the spindles SP.

If the result in the step #7 is no, to increase the rotation speed of the spindles SP, the sum of the product of the difference between the lower allowable yarn tension TSD and the average yarn tension TC and the gain gs to the present rotation speed Ns is set as a new set value of the rotation speed Ns of the spindles SP. (step #10)

In step #2, it is determined whether or not the position of the ring rail 36 coincides with a position at which the operation for making a yarn package is completed and if the result is no, the program returns to step #1. Therefore, the above-mentioned controlled operation for making yarn packages is repeated, and if the result in step #2 is yes, the above-mentioned control operation for making yarn packages is completed.

In the above-mentioned operation, the following example can be given. Namely, when producing a yarn having a cotton count of 44, the most desirable yarn tension is 25 grams, the allowable range EK of yarn tension is ±10 gram, i.e., the upper limit of the yarn tension TSU is 35 grams and the lower limit TSD of the yarn tension is 15 grams.

According to the above-mentioned operation, the average yarn tension TC of the spinning yarn can be controlled so as that is close to the desirable yarn tension TS, and if the average yarn tension TC is not maintained in the allowable range EK of the most desirable yarn tension TS, in spite of increasing the rotation speed N of the rotary ring body 2 in relation to the rotation speed NS of the spindles SP set in the spinning program, the rotation speed NS of the spindles SP is changed to maintain the average yarn tension TC in the allowable tension range EK, as mentioned above, and thus the average yarn tension TC can be controlled to be in the allowable range EK of the yarn tension.

As it can be understood from the above explanation, the rotary ring spinning device according to the present invention provides the following advantages;

(1) Since only electric wiring is needed to drive the rotary ring spinning device 1, auxiliary elements such as piping for supplying compressed air for driving the rotary ring bodies, which need additional space for arrangement, can be omitted and a possible complex construction of the rotary ring spinning device can be avoided.

(2) Since possible yarn breakages can be eliminated during the starting periods for forming a bottom end portion of the yarn package, and for forming a top end portion of the yarn package while driving the spindles SP at a high speed, and even during the intermediate operation period, the spinning operation can be carried out at a high speed in a stable spinning condition, and accordingly, the production capacity of the spinning frame provided with the rotary ring spinning devices according to the present invention is raised.

(3) Since the rotor 10 is located in the annular recess formed at an almost central position of the outside cylindrical surface of the rotor ring body 2 along the axial direction thereof, and the armature 11 is disposed inside the cylindrical surface of the holder 8 at an almost central position along the axial direction thereof, at the position at which the armature 11 faces the rotor 10, the outer diameter of the rotary ring spinning device 1 can be made as small as possible, and thus is possible to provide a rotary ring spinning device 1 having a small size and able to be driven in a stable condition. Therefore, it is possible to prevent a possible enlargement of the spindle distance required when arranging the conventional rotary ring spinning device, and accordingly, the number of rotary ring spinning devices arranged on a ring spinning frame can be any desirable number.

The following modifications can be applied to the rotary ring spinning device mentioned above.

(1) In the above-mentioned preferred embodiment, when the spinning operation for making a full size yarn package under the control of the program, as the first step of the control operation, the average yarn tension TC is compared with the most desirable yarn tension TS. However, instead of a comparison with the most desirable yarn tension TS, the allowable tension range EK can be compared with the average yarn tension TC, in the above-mentioned comparing operation.

(2) To eliminate possible fanout limitations, of the signals related to the rotation speed of the spindles SP and the rotary ring bodies 2, a plurality of identical signals can be output and then the output signals separated by a buffer.

(3) Where the program is made in such a way that the rotation speeds of the spindles SP and the rotary ring bodies 2 are designed to create the most desirable yarn tension TS related to a specified kind of the yarn, or the variation of the tension TC of the spinning yarn can be absorbed by other means, the adjustment of the rotation speed of the ring motor of the rotary ring spinning device 2 is omitted, and it is possible instead to control the rotation speed of the spindles SP and the rotary ring bodies 2.

(4) In the above-mentioned embodiment, the spinning program is stored in the ROM 73 or the external memory 77. In such a storing process, the program can be designed as a pure program for providing an output indicating the number of rotations of the spindles SP and the rotary ring bodies 2 corresponding to the ratio of the instant size of the yarn package to the full size of the yarn package, or it is possible to utilize a table wherein data on how to change the above-mentioned rotation speeds is related to the above-mentioned ratio. It is also possible to store data for controlling the rotation speed of the spindles SP in a memory while data for controlling the rotation speed of the rotary ring bodies 2 is stored separately in respective memories. For example, for the rotary ring body 2, data on the relationship between the number of rotations of the rotary ring bodies 2 to the rotation speed SP are stored together in a table.

(5) In the above-mentioned embodiment, if the override control of the rotation speed NS of the spindles SP based upon the average yarn tension TC of the spinning yarn 44 is not applied, since it is not necessary to set the spinning program based upon the stretch length or the ratio of the instant size of the yarn package to the size of the full packaged yarn package, and it is possible to set the spinning program in accordance with the instant time to the expiration of time. In this case, the parameter of the spinning program is the expiration of time.

(6) The control system of the rotation speeds of the spindles SP and the rotary ring spinning bodies 2 according to the spinning program mentioned above can be applied to other cases, for example, when utilizing a D.C. motor arranged inside the rotary ring spinning device for driving the rotary ring bodies.

Figure 8:
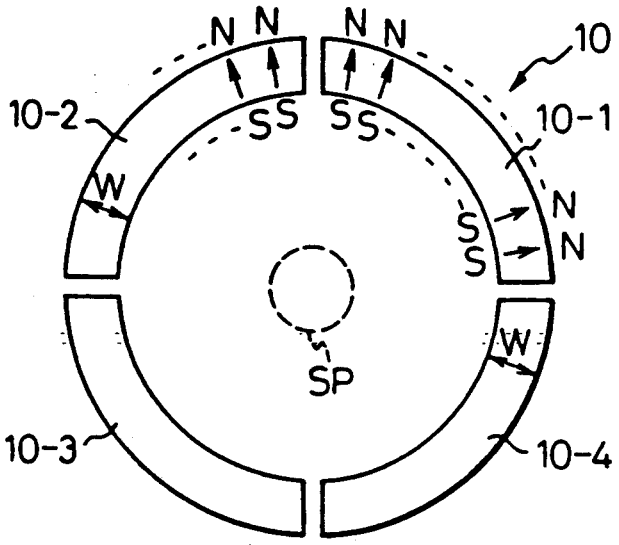
FIG. 8 is a broken away plan view of a rotor utilized for the ring motor disposed in the rotary ring spinning device shown in FIG. 1.
Figure 9A:
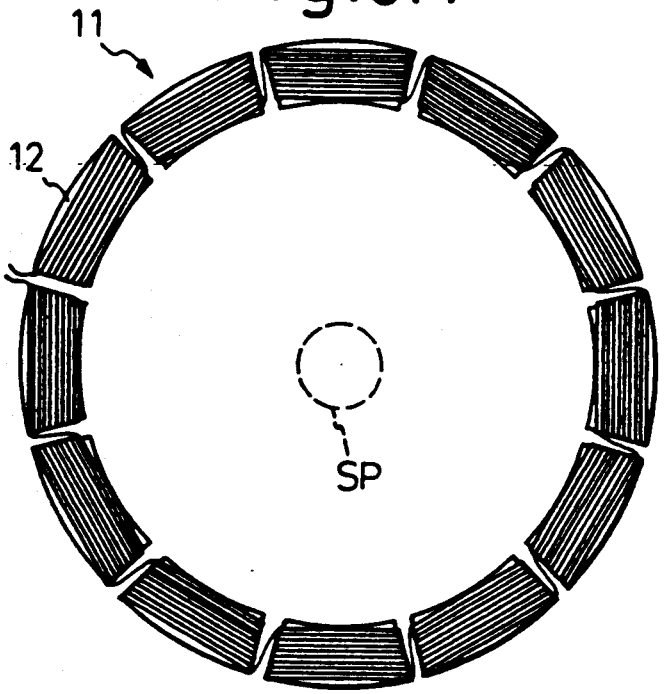
FIG. 9A is a partly broken away plan view of a armature of a ring motor disposed in the rotary ring spinning device shown in FIG. 1; and, FIG. 9B is a partly broken away plan view of a part of the armature shown in FIG. 9A.
Figure 9B:
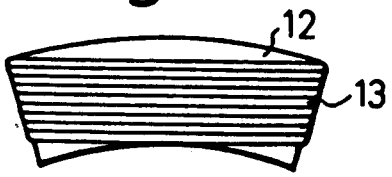

(7) To provide a small size inner ring motor, the following technical concept is practical, as shown by an embodiment of this concept in FIGS. 8, 9A and 9B. In FIG. 1, showing the construction of the rotary ring spinning device, the rotor 10 is arranged coaxially to a bobbin 42 mounted on a spindle. If it is necessary to provide a small size rotary ring spinning device having a space which allows the formation of a yarn package having a size not smaller than the yarn package produced by the conventional ring spinning frame, the space of the ring motor itself must be reduced.

To this end, the radial thickness of the rotor 10 is designed to be as small as possible, while still providing a sufficiently strong magnetic power necessary for creating a required drive power for the ring motor. Therefore, a plurality of thin permanent magnets 10-1, 10-2, 10-3, 10-4 able to generate a strong magnetic field in a radial direction, and each having a shape which can form a part of a ring shape, are utilized. As the material of the thin permanent magnets, materials such as cobalt systems metal, Nd-Fe (Neodymium-iron) series metal, and other rare earth system materials, are utilized.

The rotor 10 is constructed by a plurality of such permanent magnets equidistantly arranged as shown in FIG. 8, and these elements are remagnetized to generate a radial magnetic field in the N→S direction. Instead of the above-mentioned magnetizing of the permanent magnet materials, a magnetizing which creates a radial magnetic field of S→N, can be applied. As mentioned above, a very practical rotor 10 provided with multiple polarities generated by the above-mentioned plurality of materials formed by the permanent magnets can be provided, to satisfy the above-mentioned requirement.

As shown in FIGS. 9A and 9B, the armature 11 is disposed in the ring motor 9 coaxially outside the rotor 10, with a small gap intervened therebetween. The armature 11 comprises a plurality of cores 12 made of a magnetic material and magnetizing wires 13 would around the respective cores 12 so that plurality of magnetic fields radially extending from the core 12 can be created.

The magnetizing wires of adjacent cores 12 are connected to each other, except for only one pair of cores adjacent to each other, because the connected magnetizing wires formed as mentioned above must be used to connect the terminals thereof to a motor drive controller (not shown).

According to the technical concept mentioned above, it is possible to provide a rotary ring spinning device wherein a small size ring motor is disposed. It is also possible to introduce a unique system of controlling the rotation speed of the rotary ring body provided with an inner ring motor, whereby the variation of a yarn tension due to a difference in the stretch length, change of the instant size of yarn package, and variation of the yarn tension in the instant position of the ring rail in each formation, can be effectively controlled, during period of making a full size yarn package, within a desirable range of yarn tension which is lower than a tension at which a possible breakage of yarn may occur, by controlling the rotation speed of all of the rotary ring bodies of a spinning frame, without the application of the known method of reducing the rotation speed of these spindles. Therefore the rotation speed of the spindles of the ring spinning frame can be remarkably raised and accordingly, a great advantage of the present invention is the introduction of a spinning machine in which the spinning operation is very stable, without yarn breakage, and at a remarkably high speed driving condition whereby the production capacity is remarkably increased. It is also confirmed that the yarn quality can be maintained at high level when produced by the rotary ring spinning device according to the present invention, due to the application of the system for controlling the rotation speed of the rotary ring body as mentioned above.

(8) Instead of utilizing a means for detecting the lifting-length between the upper most position and the lower most position of the ring rail, as mentioned in the explanation of the preferred embodiment, the known heart-cam mechanism, which controls the lifting motion of the ring rail, can be utilized. That is, the rotation angle of the heart-cam is angularly divided, and these divided rotation angles are successively detected by a rotary-encoder, or pulse generator, etc. in accordance with the rotation of the heart-cam, so that signals obtained from the relationship between the instant rotation angle of the heart-cam and the instant eccentric length at the time of the related instant rotation angle, can be detected, and from such detected data, the lifting-length of the inner most and lower most position of the ring rail in the formation of each chase of a yarn package can be detected.

(9) In the above-mentioned embodiment, other types of material, dimensions, constructions, shapes and material of the rotary ring body 2, a ring motor 9, photocell-sensor 27 etc. can be utilized. Further, the circuits and construction of the control device 70 can be modified as long as the basic function of the control system according to the present invention is not change. Further, the functions depending upon the CPU can be changed by a suitable hardware.

(10) According to the present invention, it is possible to provide a rotary ring spinning device wherein a small size ring motor is disposed. It is also possible to introduce a unique system for controlling the rotation speed of the rotary ring provided with an inner ring motor, whereby variations of yarn tension due to differences of stretch length, changes of the instant size of yarn packages, and further, variations of yarn tension in the instant position of the ring rail in each chase formation, can be effectively controlled, while making a full size yarn package, within a desirable range of yarn tension which is lower than a tension at which a breakage of yarn may occur, by controlling the rotation speed of all of the rotary ring bodies of a spinning frame, besides applying the known method of reducing the rotation speed of the spindles. Therefore, the rotation speed of the spindles of the ring spinning frame can be remarkably raised. Accordingly, a great advantage of the present invention is the of a spinning machine which can of be operated in a very stable condition, without yarn breakage, and at a remarkably high speed driving condition whereby the production capacity is remarkably increased. It is also confirmed that the yarn quality can be maintained at a high level according to the rotary ring spinning device of the present invention, when applying the system for controlling the rotation speed of the rotary ring body as mentioned above.

We claim:

1. A rotary ring spinning device utilized for a ring and traveler spinning machine provided with a conventional ring rail lifting mechanism and spindle driving mechanism, said rotary ring spinning device comprising, a horizontal annular holder rigidly mounted on said ring rail, a horizontal annular ring body rotatably mounted on said horizontal annular holder by way of a bearing, a spindle arranged coaxially in an inside space of said horizontal annular rotary ring body, said spindle being driven by said driving mechanism, an inner motor coaxially disposed between said rotary ring body and said holder with respect said spindle at a central position of a coaxial line of said rotary ring body and holder, said inner motor comprising, an annular rotor made of a permanent magnet material and rigidly and coaxially mounted on an outside peripheral surface of said rotary ring body at a central axial position thereof, an annular armature rigidly and coaxially mounted on an inside peripheral surface of said holder at a central axial portion thereof, to provide a small annular space between said armature and an outside peripheral surface of said annular rotor, said inner motor being driven by an external electrical power source input thereto.

2. A rotary ring spinning device according to claim 1, wherein said rotary ring spinning device is combined with a system for controlling a rotation of said rotary ring body and said spindles, said controlling system comprising, a control device for controlling a rotation speed of said rotary ring body by controlling the external electric power input thereto, and a conventional control device for controlling said rotation of said spindles.

3. A rotary ring spinning device according to claim 2, wherein said control device for controlling a rotation of said rotary ring body, comprises, means for detecting a spinning yarn tension, means for setting a most desirable spinning yarn tension, means for comparing a signal issued from said detecting means to said most desirable yarn tension, setting means for controlling said rotation speed of said rotary ring body according to a signal issued from said comparing and judging means so that said spinning yarn tension is close to said most desirable spinning yarn tension.

4. A rotary ring spinning device according to claim 2, wherein said control device for controlling a rotation speed of said rotary ring body comprises, means for detecting a spinning yarn tension, means for setting a most desirable spinning yarn tension, means for judging whether a signal issued from said detecting means is within an allowable range with regard to said most desirable spinning yarn tension, means for controling said rotation speed of said rotary ring body based upon a signal issued from said judging means so that said spinning yarn tension is maintained in said allowable range of said most desirable spinning yarn tension.

5. A rotary ring spinning device according to claim 2, wherein said control system is provided with a first means for detecting rotation speed of a plurality of said rotary ring bodies, a second means for detecting rotation speed of said spindles, means for comparing rotation speeds detected by said first and second detecting means, and means for controlling rotation speed of said rotary ring bodies in an allowable ratio to rotation speed of said spindles which is preset in a most desirable condition, based upon the result obtained from said comparing means.

6. A rotary ring spinning device according to claim 1, further comprising a control system for controlling rotation speed of said spindles and rotation speed of said rotary ring bodies, said control system being provided with (a) a control program for controlling said rotation speed of said spindles to a preset speed from a starting time of producing a full size yarn package to a time of completion of said operation, said program including a starting program for achieving a preset rotation speed of said spindles after several seconds from the time of starting the driving of said spindles, (b) a control program for controlling said rotation speed of said rotary ring bodies to a speed which is preset in relation to said program for controlling said rotation of said spindles, (c) means for controlling rotation speed of said inner motor by said program for controlling said rotation speed of said rotary ring body, (d) delay means for starting rotation of said rotary ring bodies at a time when said speed of said spindles becomes said preset rotation speed said control program for controlling rotation speed of said rotary ring bodies being provided with a program for controlling rotation speed of said rotary ring bodies in a range of between 40% and 60% of said rotation speed of said spindles except for periods for winding a starting portion and a final portion of said full size yarn package, a program for reducing said rotation speed of said rotary ring bodies at an identical time when said rotation speed of said spindles is started to reduce from a maximum speed thereof at a time when the size of said yarn package becomes a size of about 90% of said full size yarn package, a program for further reducing said rotation speed of said rotary ring bodies started at an identical time when driving of said spinning frame is switched off, to stop rotation of said rotary ring bodies at a time not later than a time when said rotation of said spindles is completely stopped.

7. A rotary ring spinning device according to claim 6, further comprising means for setting a most desirable spinning yarn tension in said program for controlling the rotation speed of said rotary ring bodies, whereby, the rotation speed of said rotary ring bodies is controlled by a result of a comparison of detected yarn tension with said most desirable spinning yarn tension so that said rotation speed of said rotary ring bodies is adjusted to maintain said spinning yarn tension at a value close to said most desirable spinning yarn tension in relation to said preset program.

8. A rotary ring spinning device according to claim 6, wherein said preset program related to the rotation of said rotary ring body includes a program for driving said spindles at a highest driving speed not higher than 50% of said maximum rotation speed of said spindles.

9. A rotary ring body according to claim 6, including speed control means operable so that during the control of said rotation speed of said rotary ring body, said rotation speed is further precisely adjusted in relation to a forming of each chase.

10. A rotary ring body according to claim 6, wherein in said comparison program, an allowable range is set for said most desirable spinning yarn tension so that said comparison of a spinning yarn tension is carried out to determine whether said detected spinning yarn tension is within said allowable range of said most desirable spinning yarn tension.

* * * * *

UNITED STATES PATENT AND TRADEMARK OFFICE

CERTIFICATE OF CORRECTION

PATENT NO. : 5,009,063

DATED : April 23, 1991

INVENTOR(S) : Hiroshi YAMAGUCHI et al

It is certified that error appears in the above-identified patent and that said Letters Patent is hereby corrected as shown below:

On the first page (title page) the Assignee information should read:

Item [73] Assignees: -- Hiroshi Yamaguchi Japan; Hiroshi Kimura Japan; Masashi Yamaguchi, Japan --

Signed and Sealed this

Eighth Day of December, 1992

*Attest:*

*Attesting Officer*

DOUGLAS B. COMER

*Acting Commissioner of Patents and Trademarks*